United States Patent [19]

Holzmüller et al.

[11] Patent Number: 4,973,502

[45] Date of Patent: Nov. 27, 1990

[54] FILM FOR COVERING A MICROWAVABLE MEAL TRAY

[75] Inventors: Arno Holzmüller, Kempten; Bruno Bürkel, Ammersbek, both of Fed. Rep. of Germany

[73] Assignee: Unilever Patent Holdings B.V., Rotterdam, Netherlands

[21] Appl. No.: 355,024

[22] Filed: May 22, 1989

[30] Foreign Application Priority Data

May 20, 1988 [DE] Fed. Rep. of Germany ..... 3817275

[51] Int. Cl.[5] ..... B29D 22/00

[52] U.S. Cl. ..... 428/35.8; 428/36.92; 426/107; 426/234

[58] Field of Search ..... 428/195, 35.8, 36.92; 426/107, 109, 234, 243, 113, 114

[56] References Cited

U.S. PATENT DOCUMENTS

| | | | |
|---|---|---|---|
| 3,079,913 | 3/1963 | Nelson | 426/107 |
| 4,230,924 | 10/1980 | Brastad et al. | 426/107 |
| 4,656,325 | 4/1987 | Keefer | 426/107 |
| 4,676,857 | 6/1987 | Scharr et al. | 426/107 |

*Primary Examiner*—Marion C. McCamish
*Assistant Examiner*—J. Weddington
*Attorney, Agent, or Firm*—Cushman, Darby & Cushman

[57] ABSTRACT

Film for covering a meal tray with several areas, the contents of which are to be heated up by microwaves. The covering film is coated with printing ink containing metal particles in varying volumes/distribution.

13 Claims, 1 Drawing Sheet

FILM FOR COVERING A MICROWAVABLE MEAL TRAY

FIELD OF THE INVENTION

The invention relates to a film for covering a meal tray which in particular has several areas and the contents of which are to be heated up by microwaves.

BACKGROUND OF THE INVENTION

EP-OS No. 0206811 discloses a meal tray with a lid that is provided with aluminum foil sections of different sizes, which protect the contents against the microwaves at these points. This makes it possible to treat different foods with microwaves in such a way that they are all cooked at the same time. This works very effectively, but it is very difficult and complicated to apply the aluminium foil sections.

The purpose of the invention is to treat a standard film for covering such meal trays in such a way that different amounts of energy are applied to the different parts of the meal/areas that are to be heated up.

SUMMARY OF THE INVENTION

In the solution to this problem proposed by the invention the covering film is coated with printing in which contains aluminum and/or other metals or their alloys, such as Heusler alloys, preferably in particle form, the distribution/volume of which varies according to the amount of heat that needs to be applied to the individual areas/parts of the meal.

It is possible not only to cover the individual areas with the metal to a greater or lesser extent but also to control the permeability to microwaves by applying more or less metal. It is very simple both to apply the metal itself and to vary its distribution by means of the printing process.

BRIEF DESCRIPTION OF THE DRAWINGS

Two embodiments of the invention are illustrated in the drawings.

DESCRIPTION OF THE PREFERRED EMBODIMENTS

Figure 1:
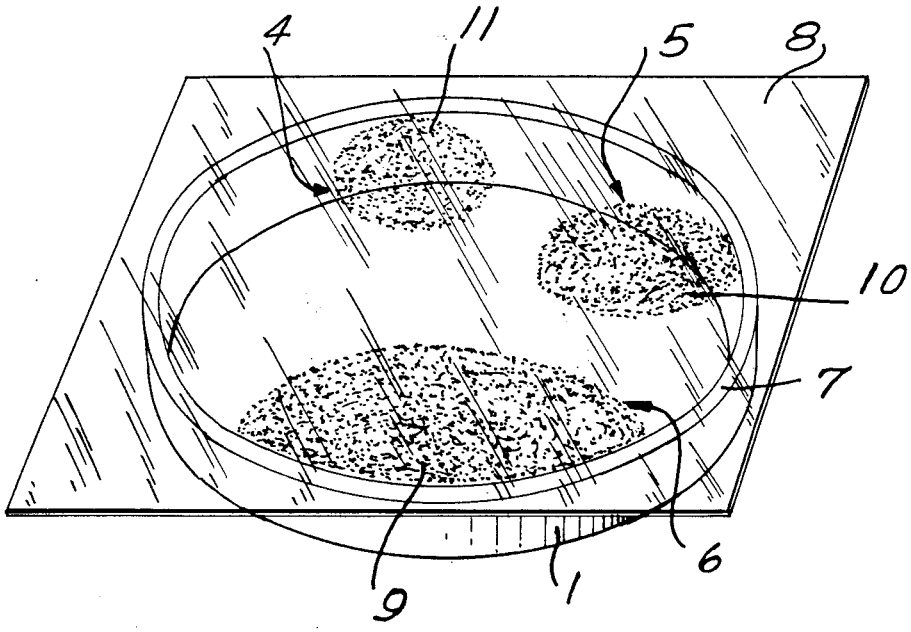
FIG. 1 shows a round meal tray that has been sealed closed by a covering film.

FIG. 1 shows a round meal tray 1 which has a sealing rim 7 on its outer edge to which a covering film 8 is sealed. This covering film is printed in a way not shown in detail here, the printing ink containing aluminum particles in the sections 9, 10 and 11. Section 9 contains about twice as much aluminum as the two other sections. The round meal tray of FIG. 1 is partitioned into three areas 4, 5 and 6.

Figure 2:
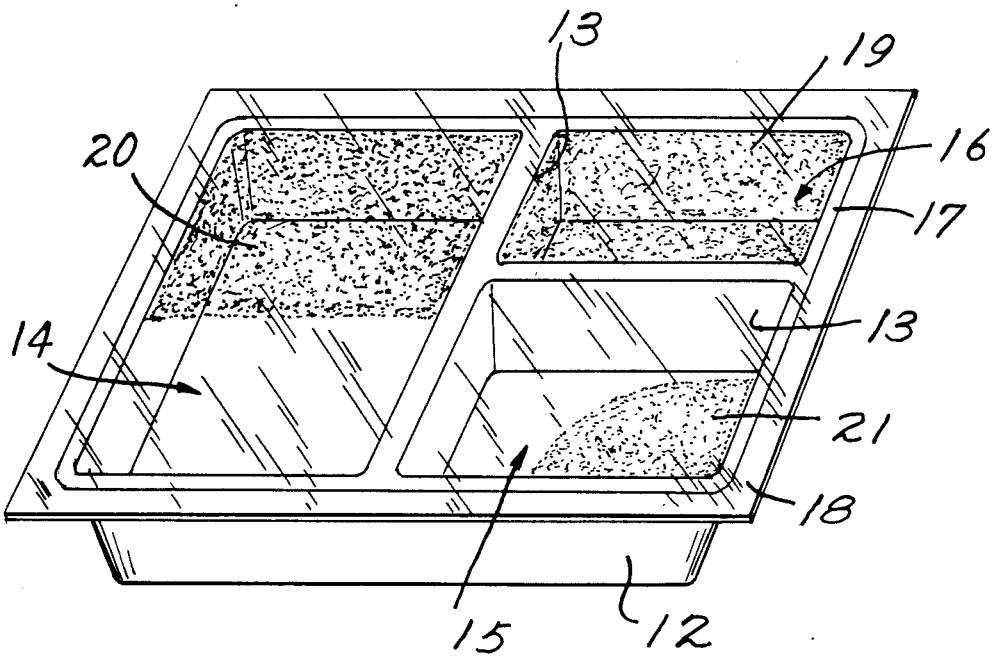
FIG. 2 shows a further meal tray with three compartments.

FIG. 2 shows a rectangular meal tray 12, which is divided up into three compartments 14, 15 and 16 by two internal partitions 13. The compartments are closed by a covering film 18, which is sealed not only to the sealing rim 17 of the meal tray 12 but also to the internal partitions 13 which are the same height. Sections 19, 20 and 21 of the covering film are again coated with printing ink that contains aluminum particles. These sections have different amounts/a different distribution of the aluminum particles, according to the product contained in the compartments.

The aluminum and/or other areas can also be covered optically by further printing inks.

We claim:

1. A meal tray including a film for covering the meal tray, where the contents of the meal tray are to be heated up by microwaves, wherein the cover film is coated at least partially with printing ink containing a Heusler alloy in particles form, the Heusler alloy changing its microwave permeability according to the temperature at which the contents of the meal tray are to be heated.

2. A meal tray including a covering for covering the meal tray, the meal tray having a plurality of heating areas, each of the heating areas having contents which are to be heated by microwave radiation passing through the covering film, the meal tray covering comprising:

a film for covering the meal tray;

a layer of printing ink coating the film at least partially, the printing ink containing a metal material, the amount of metal material in the layer of printing ink which covers each heating area being determined according to the amount of microwave radiation which is desired to reach the contents of said each area.

3. The meal tray covering of claim 2 wherein said metal material is in particle form.

4. The meal tray covering of claim 2 wherein said metal material includes aluminum.

5. The meal tray covering of claim 2 wherein said metal material includes a Heusler alloy which changes its permeability to microwaves according to temperature.

6. The meal tray covering of claim 2 further comprising a second layer of printing ink, the second layer of printing ink being applied over the layer of printing ink containing the metal material, the second layer of printing ink not affecting the amount of radiation which passes through the meal tray covering but rather affecting the optical properties of the meal tray covering.

7. A meal tray including a covering for covering the meal tray, the meal tray having a plurality of heating areas, each of the heating areas having contents which are to be heated by microwave radiation passing through the covering film, the meal tray covering comprising:

a film for covering the meal tray;

a layer of printing ink coating the film at least partially, the printing ink containing a metal material, the microwave permeability of the metal material in the layer of printing ink which covers each heating area being determined according to the amount of microwave radiation which is desired to reach the contents of said each area.

8. The meal tray covering of claim 7 wherein said metal material changes its microwave permeability according to temperature.

9. The meal tray covering of claim 7 wherein said metal material includes a Heusler alloy.

10. The meal tray covering of claim 7 wherein the microwave permeability of the metal material in the layer of printing ink is determined by the amount of the metal material in the layer of printing ink.

11. The meal tray covering of claim 10 wherein the amount of the metal material in the layer of printing ink is increased when less microwave heating is desired.

12. The meal tray covering of claim 7 wherein the metal material is in particle form.

13. The meal tray covering of claim 7 further comprising a second layer of printing ink, the second layer of printing ink being applied over the layer of printing ink containing the metal material, the second layer of printing ink being transparent to microwave radiation but affecting the optical properties of the meal tray covering.

* * * * *